US008769739B1

(12) United States Patent
McCarty et al.

(10) Patent No.: US 8,769,739 B1
(45) Date of Patent: Jul. 8, 2014

(54) BRACKET FOR RETAINING A BED MATTRESS

(71) Applicants: Philip Woods McCarty, Natick, MA (US); Philip Reid Sherman, Melville, NY (US); Chuan-Hang Shih, Lu-Kang Town (TW); Liang Liu, Lu-Kang Town (TW)

(72) Inventors: Philip Woods McCarty, Natick, MA (US); Philip Reid Sherman, Melville, NY (US); Chuan-Hang Shih, Lu-Kang Town (TW); Liang Liu, Lu-Kang Town (TW)

( * ) Notice: Subject to any disclaimer, the term of this patent is extended or adjusted under 35 U.S.C. 154(b) by 0 days.

(21) Appl. No.: 13/973,422

(22) Filed: Aug. 22, 2013

(51) Int. Cl.
*A47C 21/00* (2006.01)
*A47C 21/02* (2006.01)

(52) U.S. Cl.
CPC ..... *A47C 21/026* (2013.01)
USPC ..... 5/193; 5/426; 5/662

(58) Field of Classification Search
CPC ..... A47C 21/00; A47C 21/08
USPC ..... 5/193, 411, 426, 659, 662
See application file for complete search history.

(56) References Cited

U.S. PATENT DOCUMENTS

| | | | | |
|---|---|---|---|---|
| 1,031,656 | A * | 7/1912 | Mellon | 5/193 |
| 2,147,538 | A * | 2/1939 | Maguire et al. | 5/411 |
| 5,978,992 | A * | 11/1999 | Antinori | 5/658 |
| 7,607,181 | B1 * | 10/2009 | Harrison | 5/411 |

* cited by examiner

*Primary Examiner* — Michael Trettel
(74) *Attorney, Agent, or Firm* — Muncy, Geissler, Olds & Lowe, P.C.

(57) ABSTRACT

An easy-installable bracket for retaining a bed mattress is provided. The bracket is adapted to be disposed on a bed frame having a head portion and a feet portion. The bracket includes two seats and a bracket member. Each of the seats has a bottom plate for fixed at the feet portion of the bed frame, and an arcuate portion extended from the bottom plate. Two passages are respectively defined between the arcuate portions of the seats and the feet portion. The bracket member has a vertical portion, two front-extending sections respectively extended from two bottom ends of the vertical portion toward the head portion of the bed frame, and two parallel rear-extending sections respectively extended from distal ends of the front extending sections toward the feet portion. The rear-extending sections are slidably received in the passages respectively.

6 Claims, 4 Drawing Sheets

BRACKET FOR RETAINING A BED MATTRESS

BACKGROUND OF THE INVENTION

1. Field of the Invention

The present invention relates generally to a bracket of a bed, and more specifically to a bracket for retaining a bed mattress.

2. Description of the Related Art

Please refer to FIG. 1. A conventional bed includes a bed frame 1, a bracket 2 disposed on the bed frame 1, and a mattress 3 placed on the bed frame 1 and retained by the bracket 2. The bracket 2 has a vertical portion 4 and two hooks 5 extended from both ends of the vertical portion 4. To install the bracket 2 on the bed frame 1, one has to align the threaded portion of each screw 6, the bore on the top plate 7, the hooking space defined by one of the hooks 5, the bore on a bottom plate 8, and a threaded bore on the bed frame 1, and then the bracket 2 can be fastened after the screw 6 is tightly screwed into the threaded bore of the bed frame 1.

However, such installation process may be too difficult for some users, who, as a result, may have to pay extra money to hire someone to do the installation.

In the circumstance that the bracket 2 is installed on the bed frame 1 before delivering to the user, the protrusive vertical portion 4 of the bracket 2 will occupy additional space and can be accidentally damaged or deformed during the delivery. Therefore, a modification to the bracket is necessary.

SUMMARY OF THE INVENTION

It is a main objective of the present invention to provide a bracket that can be easily installed on a bed frame.

To achieve the above and other objectives of the present invention, a bracket for retaining a bed mattress is provided. The bracket is adapted to be disposed on a bed frame having a head portion and a feet portion. The bracket includes two seats and a bracket member. Each of the seats has a bottom plate for fixed at the feet portion of the bed frame, and an arcuate portion extended from the bottom plate. Two passages are respectively defined between the arcuate portions of the seats and the feet portion. The bracket member has a vertical portion, two front-extending sections respectively extended from two bottom ends of the vertical portion toward the head portion of the bed frame, and two parallel rear-extending sections respectively extended from distal ends of the front extending sections toward the feet portion. The rear-extending sections are slidably received in the passages respectively.

The following detailed description will further explain the full scope of applications for the present invention. However, it should be understood that the detailed description and specific examples, while indicating preferred embodiments of the invention, are given by way of illustration only, since various changes and modifications within the spirit and scope of the invention will become apparent to those with the proper technical knowledge from this detailed description.

BRIEF DESCRIPTION OF THE DRAWINGS

The present invention can be understood more fully by referring to the detailed description below, as well as the accompanying drawings. However, it must be understood that both the descriptions and drawings are given by way of illustration only, and thus do not limit the present invention.

DETAILED DESCRIPTION OF THE INVENTION

Figure 1:
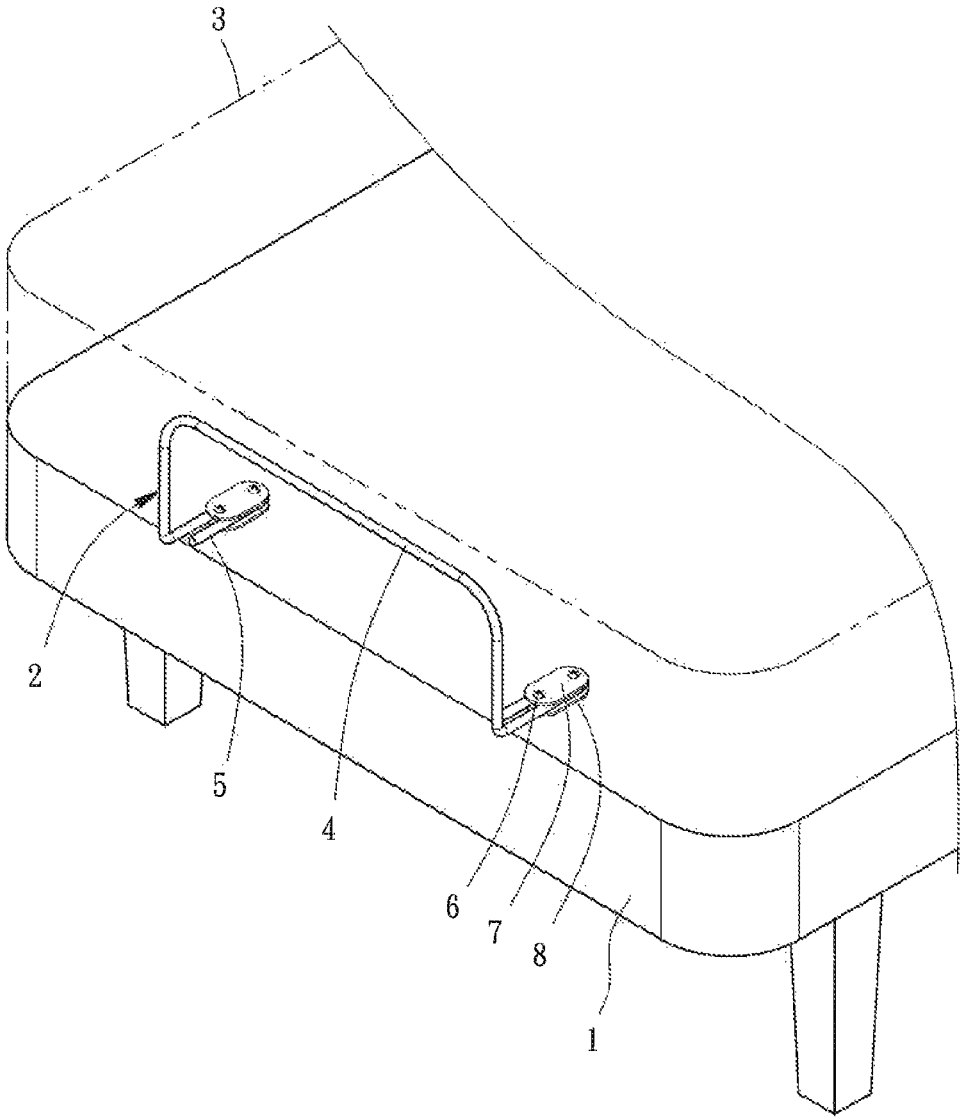
FIG. 1 PRIOR ART
FIG. 1 is a drawing of a conventional bed.
Figure 2:
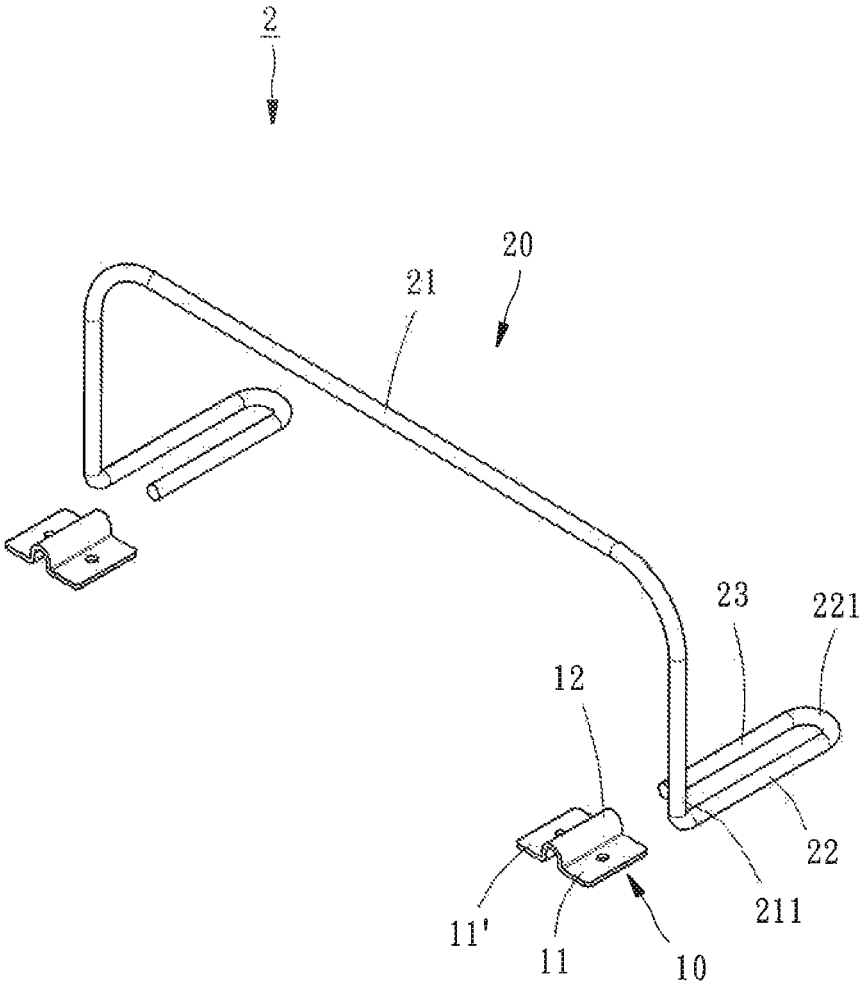
FIG. 2 is an explosive drawing of the bracket of the present invention.
Figure 4:
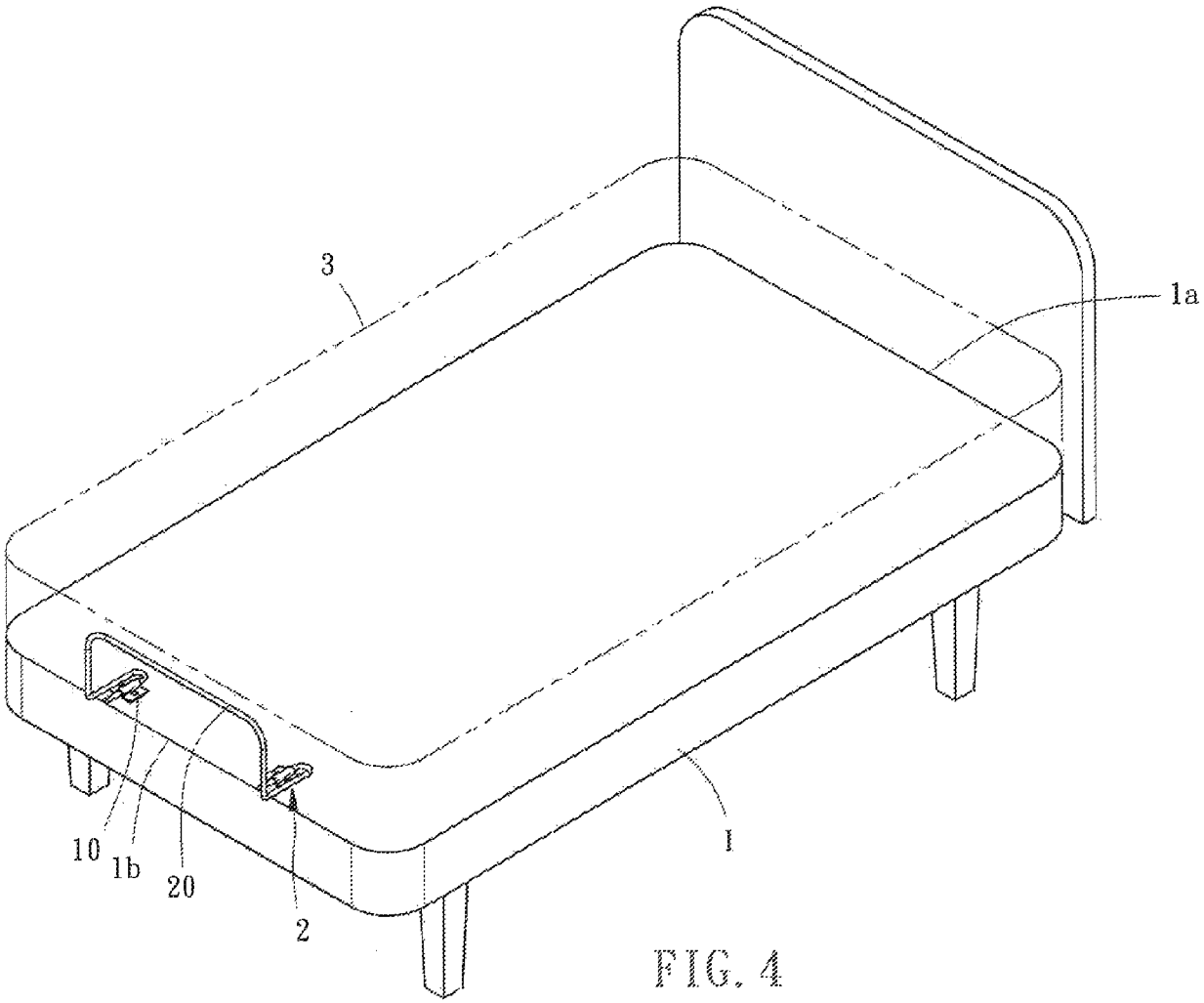
FIG. 4 is a drawing showing the installation of the bracket of the present invention after the bracket member is installed on the seats.

Please refer to FIGS. 2 and 4 for a preferred embodiment of the present invention. A bracket 2 for retaining a bed mattress 3 is shown in the drawing, in which the bracket 2 is adapted to be disposed on a bed frame 1 having a head portion 1*a*, where the head of the user normally rests, and a feet portion 1*b*, where the feet of the user normally rests. The bracket 2 includes two seats 10 and a bracket member 20.

Figure 3:
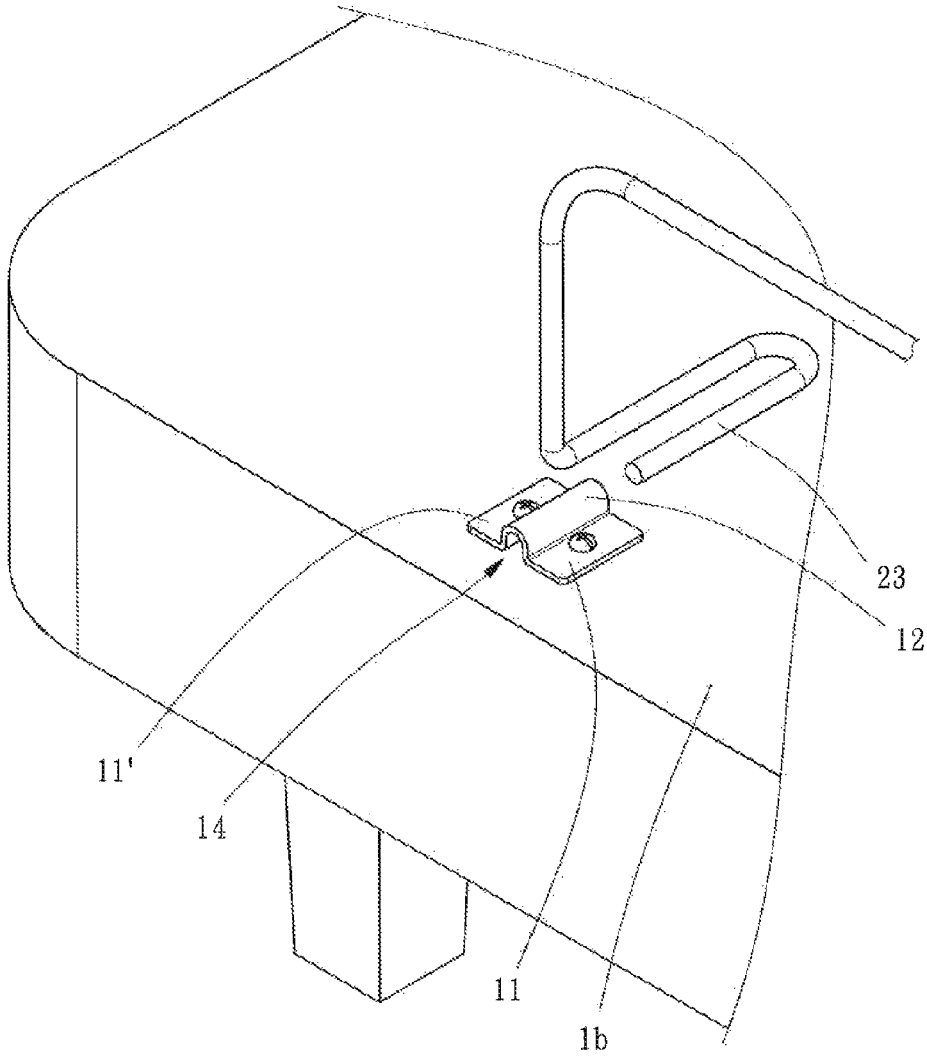
FIG. 3 is a drawing showing the installation of the bracket of the present invention before the bracket member is installed on the seats.

Each of the seats 10 has a bottom plate 11 for fixed at the feet portion 1*b* of the bed frame 1, and an arcuate portion 12 extended from the bottom plate 11. The seats 10 can be fixed on the bed frame 1 by a screw or other fixing means. In the present embodiment, the bottom plate 11 can be made rectangular, and the arcuate portion 12 extends from a long side of the rectangular bottom plate 11. To more securely fix the seats 10 on the feet portion 1*b* of the bed frame 1, each seat 10 can further have another bottom plate 11' extended from the arcuate portion 12 in a manner that the arcuate portion 12 connects the bottom plate 11 with the other bottom plate 11'. There are two passages 14, as shown in FIG. 3, respectively defined between the arcuate portions 12 of the seats 10 and the feet portion 1*b*. Each of the passages 14 has a substantially semi-circular or semi-elliptic vertical profile.

The bracket member 20 has a vertical portion 21, two front-extending sections 22 respectively extended from two bottom ends 211 of the vertical portion 21 toward the head portion 1*a* of the bed frame 1, and two parallel rear-extending sections 23 respectively extended from distal ends 221 of the front extending sections 22 toward the feet portion 4. The vertical portion 21 is substantially vertical to the bed frame 1 and is made in an "n" shape in the present embodiment. The front-extending sections 22 can also be made, but not limited to, parallel to each other. The rear-extending sections 23 can be slidably received in the passages 14 respectively such that the bracket member 20 can stand on the bed frame 1 and thus the mattress can be retained by the vertical portion 21. A distance between the rear-extending sections 23 is made, but not limited to, smaller than that between the front-extending sections 22.

To install the bracket 2 of the present invention, one can secure the seats 10 on the bed frame 1 as shown in FIG. 3. This part of the installation can be done before or after the delivery of the bed frame 1. Since the seats 10 are relatively flat, they only occupy smaller space. Due to the arcuate shape of the arcuate portions 12, the seats 10 have better mechanical strength and can withstand larger external force before permanent deformation occurs. After the seats 10 are secured, one can further install the bracket member 20 by sliding the rear-extending sections 23 rearward into the passages 14 respectively as shown in FIG. 4. After the mattress 2 is placed on the bed frame 1, the rear of the mattress 2 can abut against the vertical portion 21 of the bracket member 20 and thus be retained. The installation of the bracket member 20 is relatively simple compared with the convention ones, and thus users will have no difficulty to finish this part of the installation by themselves.

The invention described above is capable of many modifications, and may vary. Any such variations are not to be regarded as departures from the spirit of the scope of the invention, and all modifications which would be obvious to someone with the technical knowledge are intended to be included within the scope of the following claims.

What is claimed is:

1. A bracket (2) for retaining a bed mattress (3), the bracket (2) being adapted to be disposed on a bed frame (1) having a head portion (1*a*) and a feet portion (1*b*), the bracket (2) comprising:

two seats (10), each having a bottom plate (11) for fixed at the feet portion (1*b*) of the bed frame (1), and an arcuate portion (12) extended from the bottom plate (11), two passages (14) being respectively defined between the arcuate portions (12) of the seats (10) and the feet portion (1*b*); and a bracket member (20), having a vertical portion (21), two front-extending sections (22) respectively extended from two bottom ends (211) of the vertical portion (21) toward the head portion (1*a*) of the bed frame (1), and two parallel rear-extending sections (23) respectively extended from distal ends (221) of the front-extending sections (22) toward the feet portion (1*b*), the rear-extending sections (23) being slidably received in the passages (14) respectively.

2. The bracket (2) as claimed in claim 1, wherein each seat (10) further has another bottom plate (11') extended from the arcuate portion (12) for fixed at the feet portion (1*b*), the arcuate portion (12) connects one of the bottom plates (11, 11') with the other.

3. The bracket (2) as claimed in claim 1, wherein the vertical portion (21) is n-shaped.

4. The bracket (2) as claimed in claim 1, wherein a distance between the rear-extending sections (23) is smaller than that between the front-extending sections (22).

5. The bracket (2) as claimed in claim 1, wherein the front-extending sections (22) are parallel to each other.

6. A bracket for retaining a bed mattress, the bracket being adapted to be disposed on a bed frame having a head portion and a feet portion, the bracket comprising:

two seats, each seat having two bottom plate sections which extend horizontally on top of the bed frame at a distance from each other, the two bottom plate sections of each seat being connected by an arcuate section which extends upwardly from each bottom plate section away from the bed frame and in a curve horizontally, forming a passage that extends between the bed frame and the curve of the arcuate section; and a bracket member, having a vertical portion, two front-extending sections respectively extended from two bottom ends of the vertical portion toward the head portion of the bed frame, and two parallel rear-extending sections respectively extended from distal ends of the front-extending sections toward the feet portion, the rear-extending sections being slidably received in the passages respectively.

* * * * *